United States Patent [19]

Farmerie

[11] Patent Number: 5,007,205

[45] Date of Patent: Apr. 16, 1991

[54] TENSIONER RELEASE AND MECHANISM FOR BELT SANDERS

[75] Inventor: Joseph G. Farmerie, New Berlin, Wis.

[73] Assignee: Milwaukee Electric Tool Corporation, Brookfield, Wis.

[21] Appl. No.: 211,866

[22] Filed: Jun. 27, 1988

[51] Int. Cl.[5] ..... B24B 23/06

[52] U.S. Cl. ..... 51/170 EB

[58] Field of Search ..... 51/135 R, 135 BT, 148, 51/170 EB

[56] References Cited

U.S. PATENT DOCUMENTS

| | | | |
|---|---|---|---|
| 2,556,041 | 6/1951 | Pick | 51/135 |
| 3,393,573 | 7/1958 | Beckering et al. | 51/170 EB |
| 4,177,609 | 12/1979 | Rameckers et al. | 51/170 EB |
| 4,574,531 | 3/1986 | McCurry | 51/135 BT |
| 4,584,797 | 4/1986 | Wanninkhof et al. | 51/170 EB |

*Primary Examiner*—J. J. Hartman

*Attorney, Agent, or Firm*—Bayard H. Michael

[57] ABSTRACT

A roller carrying yoke is mounted on the base of the belt sander for pivotal movement about a pivot screw as controlled by the adjusting mechanism which includes a carriage bolt non-rotatably mounted in a slot in the yoke. The slot allows movement of the yoke relative to the bolt. The bolt projects through a hole in the housing and threads into the knob. A spring compressed between the yoke and the housing frictionally loads the knob so it holds adjustment. The yoke moves the roller away from the fixed roller until the roller engages and is limited by a belt. Then the loading spring is stretched to tension the belt. The tension spring force is cancelled out as the lever is actuated to pull the roller back for belt removal. When the cam follower on the yoke engages the cam (operated by the lever) the spring length remains constant and the actuating force is minimal.

6 Claims, 3 Drawing Sheets

TENSIONER RELEASE AND MECHANISM FOR BELT SANDERS

BACKGROUND OF THE INVENTION

This invention relates to belt sanders and particularly to the mechanism providing belt tension to drive a belt with minimal slippage. Typically, one of the rollers on the belt sander is spring loaded to force the roller against the belt and ensure proper drive friction. When it is desired to change the belt, the spring load on the belt has to be relieved and the typical design in the art further loads the spring which results in making it difficult to operate the release lever. Typically, this will require 15 to 20 pounds of actuating force.

CROSS REFERENCE TO RELATED APPLICATION

The tracking/biasing mechanism shown in the drawings is claimed in application Ser. No. 211867 [66044/9054], filed 6/27/88, assigned to applicant's assignee.

SUMMARY OF THE INVENTION

The object of this invention is to make it considerably easier to release the tension mechanism. The present apparatus can be operated with minimal effort i.e. in the neighborhood of 1 to 3 pounds.

The foregoing object is realized by connecting both ends of the tensioning spring to moveable points and providing a cam for positioning the yoke which anchors one end of the spring. In this way, without a belt in place, the distance between the spring anchor points remains the same in all positions of the actuating lever. Therefore, little force is necessary to actuate the lever . . . the spring load is not being changed and need not be overcome. With a belt in place, the spring force felt by the operator is minimal.

BRIEF DESCRIPTION OF THE DRAWINGS

FIG. 1 shows the front roller angled with respect to the position it should occupy.

DETAILED DESCRIPTION OF THE DRAWINGS

Figure 4:
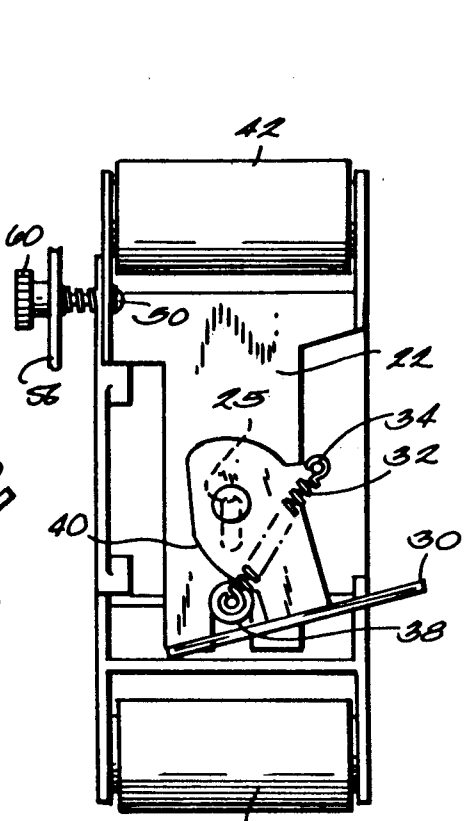
FIG. 4 is similar to FIG. 3, but shows the front roller fully retracted.
Figure 3:
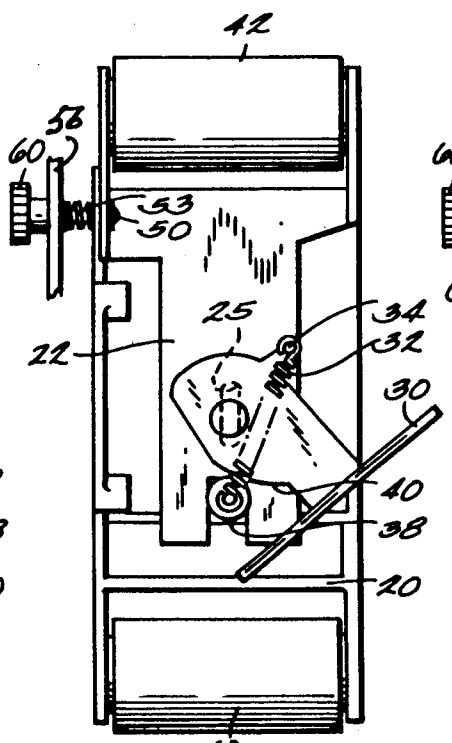
In FIG. 3 the release mechanism lever has been actuated partially to start withdrawing the front roller to relieve the tension on the belt.
Figure 2:
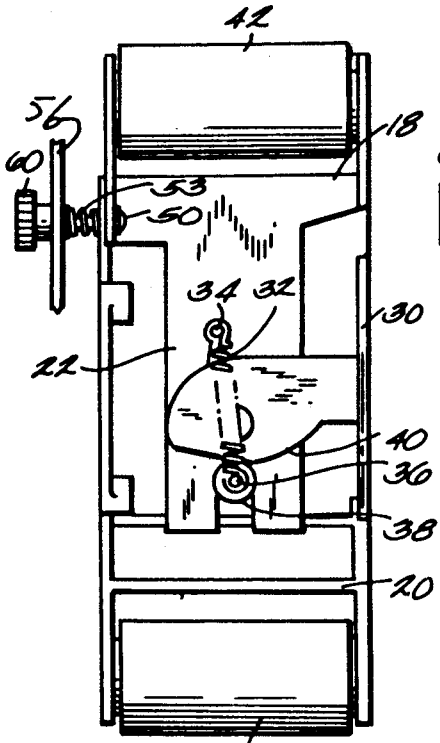
In FIG. 2 the front roller has been adjusted into parallelism with the rear roller.
Figure 5:
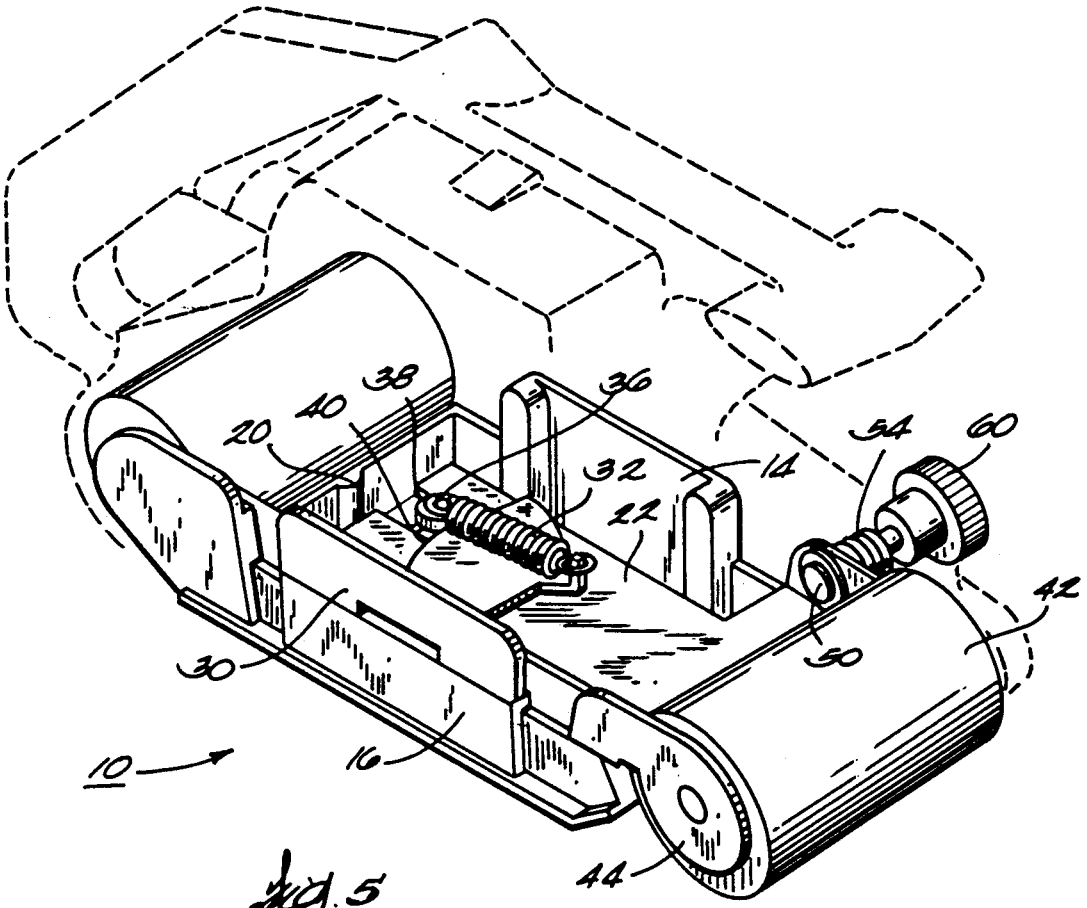
FIG. 5 is a perspective view looking down on the assembled base with the upper housing and handle shown in dashed lines for orientation purposes.
Figure 6:
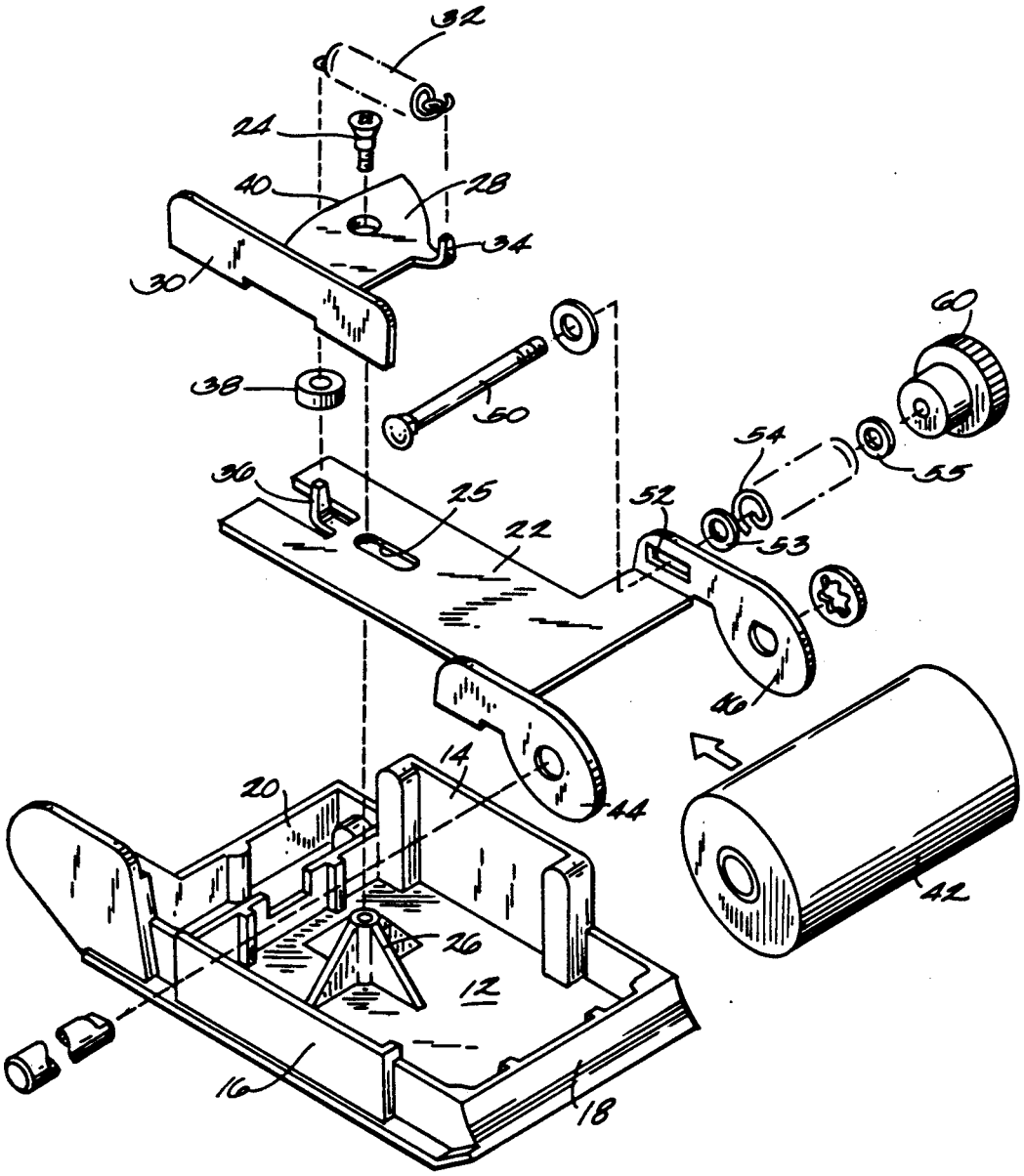
FIG. 6 is a partial exploded perspective view of the construction.

The belt sander 10 has a base 12 having side walls 14, 16 and end walls 18, 20. In FIGS. 1 through 4 the top of the figure is the front of the sander and in FIGS. 5 and 6, the right side is the front. A yoke 22 is slidably mounted for fore and aft for reciprocating movement and for limited pivotal movement on pivot screw or pin 24 which extends through slot 25 and threads into the boss 26 molded in the base. A release lever 28 is also pivoted on screw 24 and has actuated portion 30 which lies at the side of the tool and can be actuated as illustrated in FIGS. 2, 3 and 4. A spring 32 is tensioned between finger 34 on the level 28 and the finger 36 turned up from the yoke. Both points move and that differs from the prior art. The finger 36 also supports the anti-friction rolling element or bearing 38 which is engaged by the contoured cam 40 of the lever 28. The bearing functions like a cam follower. The adjusting movement of the yoke will be described later.

Referring to FIGS. 2, 3 and 4, it will be noted that as the lever 28 is rotated clockwise about pivot screw 24, the cam 40 bears against rolling element 38 to push the element and finger 36 downwardly to move the yoke 22 downwardly. That means the belt roller 42 journaled on the supports 44, 46 projecting forwardly from the yoke is moved downwardly towards the rear roller 48 journaled on the base 12. This will take tension off the sandpaper belt and permit changing the belt. During this movement, it will be noted the distance X between fingers 34 and 36 (which are the anchor points for the spring 32) does not change . . . it remains constant at X. Therefore, no force has to be exerted to change the belt except for the minimal force necessary to move the parts. When the lever 30 is moved back to its normal position in FIG. 2, the roller 42 will want to lie farther away from roller 48 than is permitted by the belt. Therefore, spring 32 will be stretched to impose a load on the belt to tension the belt and achieve the necessary drive friction. The drive is through the rear roller.

A more detailed analysis is now appropriate. In FIGS. 2–4 no belt is shown so yoke roller 38 is always pulled against cam 40 by spring 32. The force of spring 32 is cancelled out. If a sanding belt restricts movement of roller 42 away from roller 48 the bearing 38 is moved from cam 40 and the spring 32 acts to tension the belt. The spring force acting on finger 34 is to the left of pivot 24 and biases lever 28 counterclockwise to hold the lever 28 against the side of the sander as in FIG. 2. When the lever is moved towards the FIG. 3 position the spring force goes over center and becomes clockwise in the opening direction to assist opening. Somewhere around the FIG. 3 position the yoke bearing 38 would go solid against the cam 40 and the spring force would cancel out. When putting on a new belt both the motion and forces reverse at about FIG. 3 position. The belt is tight and the resisting spring force increases until going over center to FIG. 2 where the spring assists closing the lever. The force needed at the lever is less than the force applied to the belt due to the leverage of the lever. Without a sanding belt, the spring distance is always X and is always cancelled out.

Figure 1:
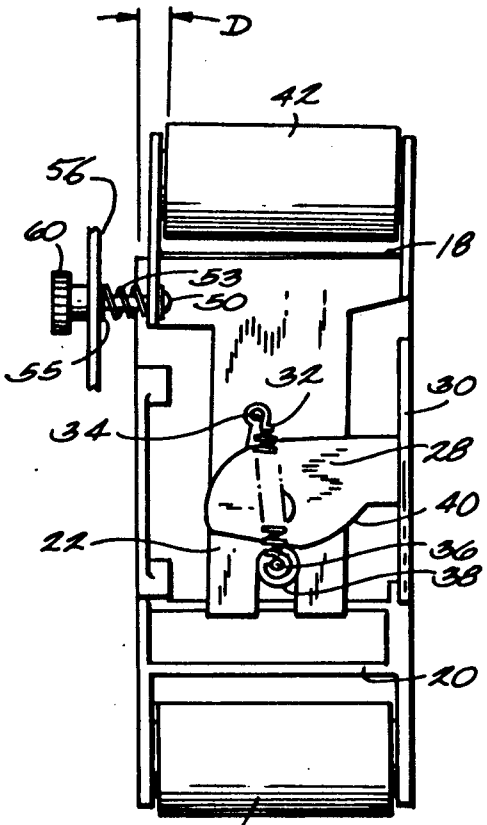
FIG. 1 is a simplified plan view showing a belt sander provided with both an improved tracking and biasing mechanism and a constant force tensioner release mechanism.

It is necessary that roller 42 be parallel to roller 48; otherwise the belt won't track right and will run off the ends. Therefore, there has to be some way to adjust the front roller to be parallel with the rear roller. In FIG. 1 the front roller 42 is out of adjustment by the distance D. Carriage bolt 50 extends through the slot 52 in the support arm 46 on the yoke. The carriage bolt may be termed a threaded pin. The usual "square" under the head of the bolt engages the slot to prevent rotation of the bolt and cooperates with the edges of slot 52 to guide the reciprocating movement of the yoke 22. Spring 54 fits over the shank of the bolt 50 and is compressed between the support arm 46 and the housing 56 which is a part of the cover and handle assembly shown in dotted lines in FIG. 5. Washers 53 and 55 provide bearing surfaces for spring 54. The carriage bolt extends through the hole in the side wall 56 and is threaded into the adjusting knob 60. When the adjusting knob 60 is tightened, it acts as a nut on the carriage bolt and pivots the yoke towards the knob. When the knob is loosened, the spring between the housing and the yoke pushes the yoke away from the knob. The knob is turned to adjust the roller 42 until it is parallel with the rear roller 48.

I claim:

1. A belt sander comprising, a base, a rear roller mounted on said base, a yoke mounted on said base for reciprocable motion, a front roller mounted on said yoke for movement farther from or closer to said rear roller to tension or relieve tension of a sanding belt mounted on the rollers, cam means rotatably mounted on said base operatively engaging said yoke for moving said yoke from or towards said rear roller, spring means connected to said yoke and said cam means and operative to bias said front roller against a sanding belt mounted on said rollers when said cam means is in its normal position, said cam means being out of contact with said yoke when said cam means is in its said normal position, and means rendering the force of said spring means ineffective at some point in movement of said cam means from said normal position to a release position in which said front roller has moved closer to said rear roller to enable removal of said sanding belt.

2. A belt sander according to claim 1 in which the force of said spring means biases said cam means to said normal position when said cam means is in said normal position.

3. A belt sander according to claim 2 in which said cam means includes a lever for operating said cam means, and a cam follower on said yoke engageable with said cam means, said spring means being connected to said cam means and to said yoke.

4. A belt sander according to claim 3 in which the distance between the point of connection of said spring means to said yoke and the point of connection of said spring means to said cam means remains substantially constant as said lever is moved between said normal and release positions so long as said follower remains in contact with said cam means.

5. A belt sander comprising, a base, a rear roller mounted on said base, a yoke mounted on said base for reciprocable motion, a front roller mounted on said yoke for movement farther from or closer to said rear roller to tension or relieve tension of a sanding belt mounted on the rollers, a lever pivotally mounted on said base for movement between a normal position and a release position, a cam actuated by said lever and operatively engaging said yoke, a tensioning spring connected to said cam and to said yoke to bias said yoke to tension the sanding belt, wherein the distance between the point of connection of said spring to said cam and said yoke remains substantially constant as said lever moves between said release position and said normal position with no belt mounted on said rollers.

6. A belt sander according to claim 5 in which said distance increases when movement of said front roller is limited by engagement with a sanding belt.

* * * * *